United States Patent [19]

Ebihara

[11] Patent Number: 4,784,307

[45] Date of Patent: Nov. 15, 1988

[54] CASSETTE TYPE STAPLER

[76] Inventor: Yoshiyuki Ebihara, 25-18 Kamiogi 4-chome, Suginami-ku, Tokyo, Japan

[21] Appl. No.: 44,144

[22] Filed: Apr. 30, 1987

[30] Foreign Application Priority Data

Sep. 26, 1986 [JP] Japan ..... 61-227476

[51] Int. Cl.[4] ..... B25C 5/00; B25C 7/00

[52] U.S. Cl. ..... 227/120; 227/127

[58] Field of Search ..... 227/109, 120, 125, 126, 227/127

[56] References Cited

FOREIGN PATENT DOCUMENTS 199162 8/1958 Austria ..... 227/127

203779 9/1962 Japan .

*Primary Examiner*—Paul A. Bell

*Attorney, Agent, or Firm*—Andrus, Sceales, Starke & Sawall

[57] ABSTRACT

A cassette type stapler includes a base (10) and a cassette holding member (14) pivotally mounted on the base and having a longitudinally extending hollow portion (24). A cassette member (26) is received in the cassette holding member. A longitudinally extending guide groove (38) is formed on one wall of the hollow portion of the cassette holding member. A guide protrusion (36) is formed on the cassette member and is engageable in the guide groove. An engagement projection (38A) is disposed on the top wall of the cassette member and a resilient locking element (42) cooperates with the engagement projection to releasably hold the cassette member. Longitudinally extending ridges (46) are formed on all the side walls of the hollow portion of the cassette holding member, with the ridges being adapted to frictionally engage the side walls of the cassette member when the latter is inserted into the cassette holding member.

4 Claims, 3 Drawing Sheets

CASSETTE TYPE STAPLER

BACKGROUND OF THE INVENTION

Field of the Invention

The present invention relates to an improved stapler of such a type that it utilizes a cassette having a set of staples previously charged thereinto.

Background

The applicant had proposed a cassette type stapler wherein a cassette is charged forwardly into a stapler body and wherein after charged, a possible play created between the cassette and the stapler body is taken out under the action of spring means. See Japanese Patent Application No. 61-45949. In our proposal, the spring means is provided on the inner face of the closed rearward end of a cassette holding member. A cassette is pressed into the hollow portion of the cassette holding member against the force of the spring means. The cassette is locked in place within the cassette holding member by locking means. In such an arrangement, it is difficult to form the spring means on the inner face of the closed rearward end of the cassette holding member. In the above arrangement, the cassette will pop out from the cassette holding member under the action of the spring means as the locking means is released from the cassette. However, the "pop-out" action is not necessarily desirable in all events.

SUMMARY OF THE INVENTION

It is therefore an object of the present invention to provide an improved stapler of the aforementioned type in which it comprises no spring means, in which a cassette can easily and positively be mounted in and removed out of the stapler, in which the cassette can positively be locked relative to a cassette holding member and in which the stapler is easy and inexpensive in manufacturing.

To this end, the present invention provides a cassette type stapler comprising a base member, a cassette holding member pivotally mounted on said base member and including a longitudinally extending hollow portion having an opened forward end and a closed rearward end, a cassette received in said cassette holding member, a handle member pivotally mounted at its rearward end on said cassette holding member, a longitudinally extending guide groove formed on one wall of said hollow portion of said cassette holding member, a guide protrusion formed on the cassette at its wall opposite to said wall of said cassette holding member and engageable in said guide groove, said guide protrusion co-operating with said guide groove to guide said cassette and to prevent said cassette from being mounted in said cassette holding member with a wrong orientation when said cassette is inserted into the hollow portion of said cassette holding member, an engagement projection on the top wall of said cassette at a position rearwardly from said guide protrusion in the longitudinal direction of said cassette, a resilient locking element pivotally provided on said cassette holding member, said locking element co-operating with said engagement projection in releasably hold said cassette when said cassette is fully inserted into the hollow portion of said cassette holding member, and longitudinally extending ridges formed on all the side walls of the hollow portion of said cassette holding member, said longitudinally extending ridges being adapted to frictionally engage the side walls of said cassette when said cassette is inserted into said hollow portion.

According to another feature of the present invention, the above object can be accomplished by providing a cassette type stapler comprising a base member, a cassette holding member pivotally mounted on said base member and including a longitudinally extending hollow portion having an opened forward end and a closed rearward end, a cassette received in said cassette holding member, a handle member pivotally mounted at its rearward end on said cassette holding member, a longitudinally extending guide protrusion formed on one wall of said hollow portion of said cassette holding member, a guide groove formed on the cassette at its wall opposite to said wall of said cassette holding member and engageable with said guide protrusion, said guide protrusion co-operating with said guide groove to guide said cassette and to prevent said cassette from being mounted in said cassette holding member with a wrong orientation when said cassette is inserted into the hollow portion of said cassette holding member, an engagement opening on the top wall of said cassette at a position rearwardly from said guide groove in the longitudinal direction of said cassette, a resilient locking element pivotally provided on said cassette holding member, said locking element co-operating with said engagement opening to releasably hold said cassette when said cassette is fully inserted into the hollow portion of said cassette holding member, and longitudinally extending ridges formed on all the side walls of the hollow portion of said cassette holding member, said longitudinally extending ridges being adapted to frictionally engage the side walls of said cassette when said cassette is inserted into said hollow portion.

In such an arrangement, the cassette type stapler can hold a cassette within the cassette holding member without spring means. Thus, the cassette type stapler is simple in construction and inexpensive in manufacturing.

DETAILED DESCRIPTION OF PREFERRED EMBODIMENT

The present invention will now be described in connection with a preferred embodiment thereof with reference to the accompanying drawings.

Figure 1:
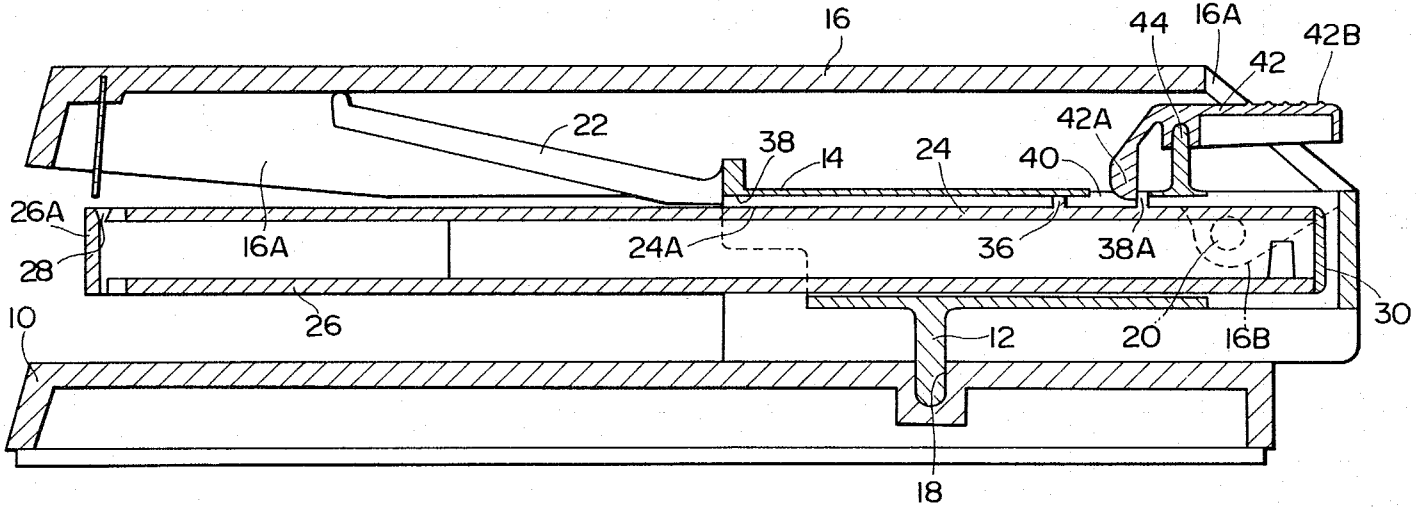
FIG. 1 is a longitudinal section of a cassette type stapler to which the present invention is embodied.
Figure 2:
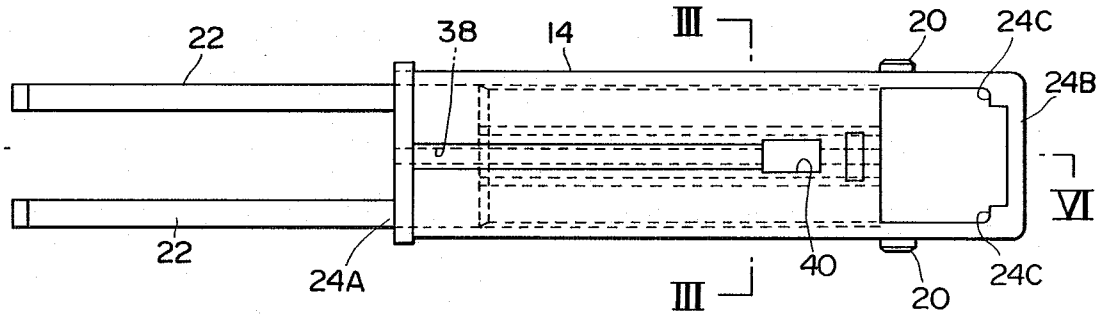
FIG. 2 is a top view of the cassette holding member shown in FIG. 1.
Figure 3:
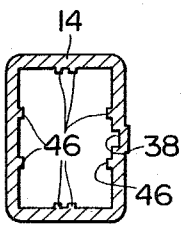
FIG. 3 is a cross-sectional view taken along line III—III in FIG. 2.
Figure 4:
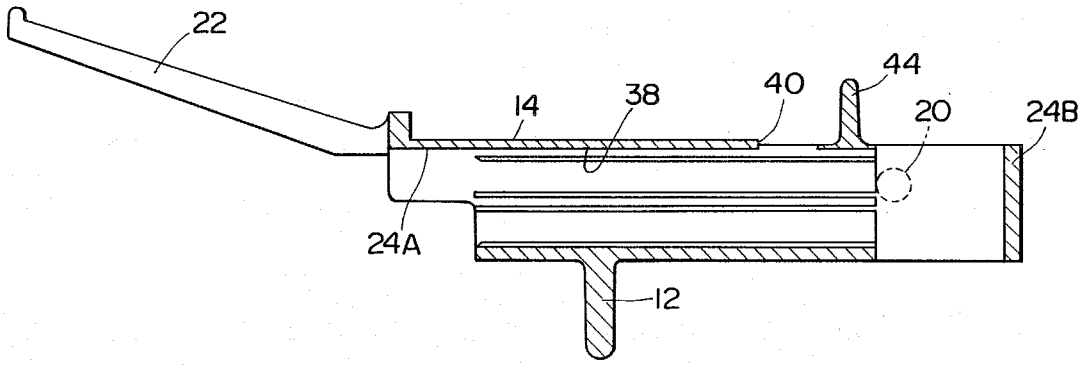
FIG. 4 is a longitudinally sectional view taken along a line IV—IV in FIG. 2.
Figure 5:
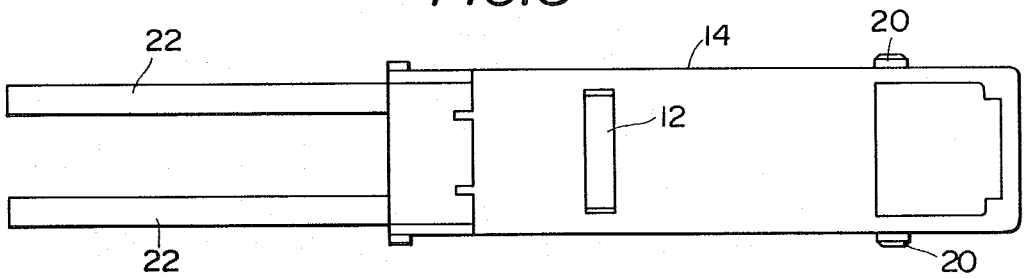
FIG. 5 is a bottom view of the cassette holding member shown in FIG. 2.

Referring now to FIG. 1, there is shown a cassette type stapler according to the present invention, which comprises a base member 10, a cassette holding member 14 pivotally mounted on the base member 10 by a spring element 12, and a handle member 16 pivotally connected at its rearward end with the cassette holding member 14.

As seen from FIGS. 1, 2, 4 and 5, the spring element 12 connecting the cassette holding member 14 with the base member 10 extends from the bottom face of the cassette holding member 14 vertically and downwardly with the lower end thereof fitted into an aperture 18 on the top of the base member 10. Thus, the cassette holding member 14 will resiliently be swingable relative to the base member 10.

A pair of transversely aligning pins 20 extend laterally from the opposite side walls of the cassette holding member 14. These pins 20 are fitted into holes on the lower extension 16B of the respective side walls 16A in the handle member 16 such that the latter will pivotally be mounted on the cassette holding member 14.

A pair of juxtaposed spring elements 22 extend forwardly and upwardly from the forward end of the cassette holding member 14. The spring elements 22 engage the inner face of the handle member 16 to bias it clockwise as viewed in FIG. 1.

The cassette holding member 14 includes a longitudinally extending hollow portion 24 which has its opened forward end 24A and its closed rearward end 24B. A cassette 26 will be inserted into the hollow portion 24 through its opened forward end 24A.

Figure 6:
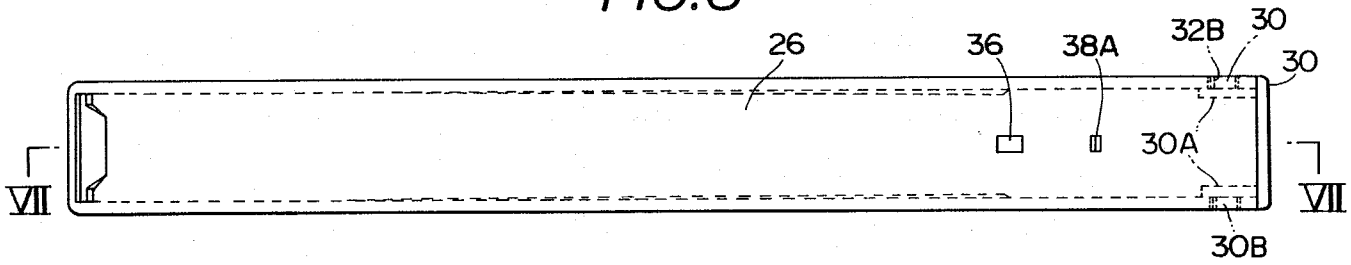
FIG. 6 is a top view of a cassette constructed in accordance with the present invention.
Figure 7:
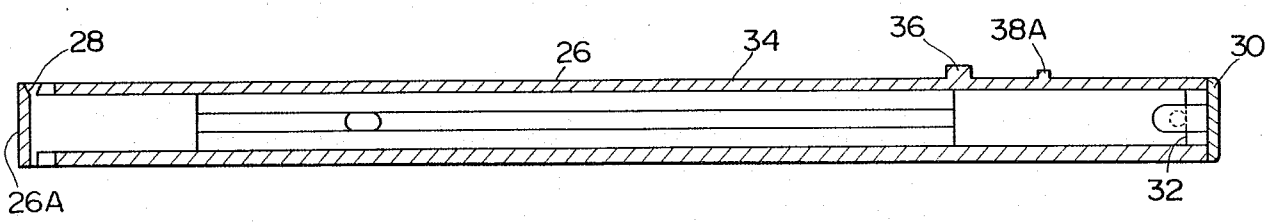
FIG. 7 is a longitudinally sectional view taken along a line VII—VII in FIG. 6.

As seen best from FIGS. 6 and 7, the cassette 26 is in the form of an elongated and hollow box. The forward end 26A of the cassette 26 includes a staple driving aperture 28 as be well-known with the rearward end thereof being opened. Although not illustrated, the cassette 26 is adapted to receive a set of staples (not shown) through the opened rearward end thereof in the well-known manner. The opened rearward end of the cassette 26 is then closed by a cap member 30 to urge the set of staples forwardly within the hollow cassette portion under the action of a spring, as be well-known. The cap 30 includes a pair of lugs 30A extending inwardly from the inner face thereof. Each of the lugs 30A includes an engagement projection 30B formed thereon at the outer face and extending laterally from the outer face of the lug 30A. Each of the engagement projections 30B engages in an engagement opening 32 formed on the corresponding side wall of the cassette. Thus, the cap member 30 can releasably be mounted on the cassette 26.

A guide protrusion 36 extends upwardly from the top face 34 of the cassette 26 and adapted to engage in a longitudinal guide groove 38 on the inner face of the top wall of the cassette holding member 14. As a result, the cassette 26 can positively be guided into the cassette holding member 14 only when the cassette 26 is inserted into the cassette holding member 14 with a proper orientation of the cassette 26 relative to the cassette holding member 14.

The cassette also includes an engagement protrusion 38A formed on the top wall of the cassette 26 at a position rearwardly from the guide protrusion 36. The height of the engagement protrusion 38A is smaller than that of the guide protrusion 36. In the illustrated embodiment, the guide protrusion 36 is longitudinally aligned with the engagement protrusion 38A. When the cassette 26 is inserted into the hollow portion 24 of the cassette holding member 14, therefore, these protrusions 36 and 38A will be moved within the same guide groove 38.

The cassette holding member 14 includes an opening 40 formed in the top wall thereof at a position which becomes directly in front of the engagement protrusion 38A when the cassette 26 is engaged by a shoulder 24C on the rearward end of the cassette holding member 14. The distal end 42A of a locking member 42 extends into the guide groove 38 of the cassette holding member 14 through the opening 40 thereof. As shown in FIG. 1, the locking member 42 is mounted on a spring element 44 which extends vertically and upwardly from the top wall of the cassette holding member 14 at a position directly behind the opening 40. The opposite end 42B of the locking member 42 extends outwardly through the opened rearward end 16A of the handle member 16. When the rearward end 42B of the locking member 42 is depressed, therefore, the locking member 42 is rotated clockwise to disengage the forward end 42A thereof out of the guide groove 38 of the cassette holding member 14. The front face of the forward end 42A of the locking member 42 is rounded such that when the cassette 26 is moved rearwardly within the hollow portion 24 of the cassette holding member 14, the engagement protrusion 38A of the cassette 26 will first move the forward end 42A of the locking member 42 in the upward direction and then engage the back side of the forward end 42A of the locking member 42. As a result, the cassette 26 can be locked in place within the cassette holding member 14. When it is wanted to release the locked cassette 26, the rearward end 42B of the locking member 42 is simply depressed to move the forward end thereof in the upward direction. Thus, the locking member 42 is disengaged from the engagement protrusion 38A to make it possible to remove the cassette 26 forwardly out of the cassette holding member 14.

In accordance with the present invention, furthermore, the cassette holding member 14 includes longitudinally extending ridges 46 on all the inner walls thereof. In the illustrated embodiment, two of such ridges 46 are formed on the respective one of the inner walls of the cassette holding member 14. When the cassette 26 is inserted into the cassette holding member 14, the ridges 46 frictionally engage the side walls of the cassette 26 such that any play between the cassette 26 and the cassette holding member 14 will be prevented. Being distinguished from the case where the side walls of the cassette 26 frictionally engage the inner walls of the cassette holding member 14 through the whole wall area, the present invention can positively prevent the play between the cassette 26 and the cassette holding member 14 under a decreased frictional force since only the ridges 46 engage the walls of the cassette 26.

In the embodiment illustrated and aforementioned, the hollow portion of the cassette holding member has the guide groove formed on the inner wall thereof while the cassette has the guide protrusion formed on the corresponding outer wall thereof. Further, the top wall of the cassette is formed with the engagement protrusion adapted to engage the locking element. However, such an arrangement may be modified without departing from the scope and spirit of the present invention. For example, a guide protrusion may be formed on any wall of the hollow portion of the cassette holding member while a guide groove may be formed on the corresponding outer wall of the cassette. Moreover, the top wall of the cassette may be provided with an engagement opening adapted to be engaged by the locking element.

What is claimed is:

1. A cassette type stapler comprising, in combination:

(a) a base (10), (b) a cassette holding member (14) pivotally mounted on said base and with said member having an elongate longitudinally extending hollow portion (24) defined by a plurality of generally planar side walls, (c) a cassette member (26) disposed within said hollow portion of said cassette holding member, and with said cassette member having a plurality of generally planar side walls, (d) longitudinally extending cooperative locating guide means (38, 36) on said members (14, 26) for guiding said cassette member in a desired orientation within said hollow portion of said cassette holding member, (e) a locking device (42) mounted to said cassette holding member, (f) means (38A) on said cassette member for cooperative locking engagement with said locking device to thereby releasably hold said cassette member when the latter is fully inserted into said hollow portion of said cassette holding member, (g) and longitudinally extending rib means (46) disposed on all of said side walls of one of said members and with said rib means engaging all of said side walls of the other of said members to essentially prevent play between said members throughout their length with a minimum of friction therebetween when said cassette member is inserted into said hollow portion of said cassette holding member.

2. The cassette type stapler of claim 1 wherein:

(a) said rib means (46) comprises a pair of spaced generally parallel ribs on each said side wall of said one of said members, (b) and said cooperative guide means (38, 36) is disposed between one of said rib pairs.

3. The cassette type stapler of claim 1 wherein said rib means (46) is disposed on the said side walls of said cassette holding member (14) and frictionally engage the generally planar said side walls of said cassette member (26).

4. The cassette type stapler of claim 3 wherein (a) said rib means (46) comprises a pair of spaced generally parallel ribs on each said side wall of said one of said members, (b) and said cooperative guide means (38, 36) is disposed between one of said rib pairs.

* * * * *